US011732987B1

(12) United States Patent
Chen

(10) Patent No.: US 11,732,987 B1
(45) Date of Patent: Aug. 22, 2023

(54) MAGAZINE LOADER

(71) Applicant: Xiaoxun Chen, Puning (CN)

(72) Inventor: Xiaoxun Chen, Puning (CN)

( * ) Notice: Subject to any disclaimer, the term of this patent is extended or adjusted under 35 U.S.C. 154(b) by 0 days.

(21) Appl. No.: 17/967,329

(22) Filed: Oct. 17, 2022

(30) Foreign Application Priority Data

Apr. 13, 2022 (CN) ..... 202220852396.2

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/82
See application file for complete search history.

(56) References Cited

U.S. PATENT DOCUMENTS 2,856,720 A * 10/1958 Kunz ..... F42B 39/10 42/87
4,689,909 A * 9/1987 Howard ..... F41A 9/83 42/87
4,706,402 A * 11/1987 Csongor ..... F41A 9/83 42/87
4,862,621 A * 9/1989 Kearney ..... F41A 9/83 42/87
5,355,606 A * 10/1994 Origoni ..... F41A 9/83 42/87
6,754,987 B1 * 6/2004 Cheng ..... F41A 9/83 42/87
6,817,134 B2 * 11/2004 Newman ..... F41A 9/83 42/87
7,257,919 B1 * 8/2007 Farley ..... F41A 9/83 42/87
7,383,657 B2 6/2008 Pikielny
7,637,048 B2 * 12/2009 Tal ..... F41A 9/83 42/87
7,805,874 B2 * 10/2010 Tal ..... F41A 9/84 42/87
9,212,859 B1 * 12/2015 Tal ..... F41A 9/83
9,618,286 B1 * 4/2017 Plate ..... F41A 9/83
9,689,633 B1 * 6/2017 Plate ..... F41A 9/83
10,145,635 B2 * 12/2018 Hefer ..... F41A 9/83
10,215,516 B2 * 2/2019 Hefer ..... F42B 39/26
10,222,155 B2 * 3/2019 Hefer ..... F41A 9/84
10,240,878 B1 * 3/2019 Hefer ..... F41A 9/83
10,330,411 B2 * 6/2019 Cottrell ..... F41A 9/83
10,495,397 B2 * 12/2019 Hefer ..... F41A 9/83
10,557,677 B1 * 2/2020 Martelli ..... F41A 9/67
10,641,566 B2 * 5/2020 Cottrell ..... F41A 9/83
(Continued)

*Primary Examiner* — Michelle Clement
(74) *Attorney, Agent, or Firm* — Jeenam Park

(57) ABSTRACT

The present disclosure provides a magazine loader for loading a cartridge into a magazine. The magazine loader has a housing, a stopper, a cartridge loading slide and a guider mounted on the housing. The housing has a recessed portion as a magazine opening for receiving at least a portion of the magazine. The recessed portion of the housing has a front wall, a rear wall and a rear wall with a cartridge opening. A cartridge loading slide with an angle relative to a horizontal line is located on the bottom wall of the recessed portion. The cartridge loading slide has a linear channel aligned with the cartridge opening, a length of the linear channel is less than a distance between the front wall and the rear wall and greater than a width of the magazine.

17 Claims, 12 Drawing Sheets

(56) References Cited

U.S. PATENT DOCUMENTS

| | | | | |
|---|---|---|---|---|
| 10,830,547 | B2 * | 11/2020 | Cottrell | F41A 9/83 |
| 10,976,121 | B2 * | 4/2021 | Draper | F41A 9/83 |
| 11,041,684 | B1 * | 6/2021 | Higby | F41A 9/84 |
| 11,248,865 | B2 * | 2/2022 | Rosenblum | F41A 9/38 |
| 11,313,634 | B1 * | 4/2022 | Newby | F41A 9/83 |
| 11,506,462 | B1 * | 11/2022 | Newby | F41A 9/83 |
| 2007/0017140 | A1 * | 1/2007 | Pikielny | F41A 9/83 42/87 |
| 2009/0044440 | A1 * | 2/2009 | Tal | F41A 9/84 42/87 |
| 2010/0175294 | A1 * | 7/2010 | Meinel | F41A 9/83 42/87 |
| 2013/0061505 | A1 * | 3/2013 | Faifer | F41A 9/83 42/87 |
| 2013/0192117 | A1 * | 8/2013 | Meinel | F41A 9/83 42/87 |
| 2013/0232843 | A1 * | 9/2013 | Bajuelo | F41A 9/83 42/87 |
| 2014/0298704 | A1 * | 10/2014 | Niccum | F41A 9/83 42/87 |
| 2015/0377573 | A1 * | 12/2015 | Niccum | F41A 9/83 42/87 |
| 2017/0211902 | A1 * | 7/2017 | Mills | F41A 9/83 |
| 2018/0058785 | A1 * | 3/2018 | Hefer | F41A 9/83 |
| 2018/0094888 | A1 * | 4/2018 | Hefer | F41A 9/84 |
| 2018/0202735 | A1 * | 7/2018 | Draper | F41A 9/82 |
| 2020/0124367 | A1 | 4/2020 | Fischer | |
| 2020/0173746 | A1 * | 6/2020 | Hefer | F41A 9/83 |
| 2021/0231402 | A1 * | 7/2021 | Morris | F41A 9/82 |
| 2022/0373280 | A1 * | 11/2022 | Couie | F41A 9/83 |

* cited by examiner

B—B

C—C

MAGAZINE LOADER

CROSS-REFERENCE TO RELATED APPLICATIONS

The present disclosure claims priority to Chinese Patent Application No. 202220852396.2 filed on Apr. 13, 2022, the content of which is incorporated herein by reference in its entirety.

TECHNICAL FIELD

The present disclosure relates to the field of firearm magazine loaders, and more particularly, to a firearm magazine loader that assists a user to compresses the spring of a magazine and then insert cartridges into the magazine. Although embodiment of the invention is suitable for a wide scope of applications, it is particularly suitable for the rapid loading of magazines for firearms.

BACKGROUND

The magazine usually needs to be filled with cartridges before or after the firearm is fired. However, the loading method usually requires fingers to directly press the cartridge into the magazine, which brings inconvenience to the user. With the increase in the spring force in the magazine, loading will be more time-consuming and laborious. In fact, the amount of force necessary to insert a round into the magazine increases with each round. This makes fully loading cartridges into high-capacity double stack magazines difficult. When loading multiple high-capacity magazines, it is not uncommon for users to experience pain in their fingers and thumbs due to the amount of stress placed on the user's thumbs during the loading process. This process is tedious, time-consuming, painful, and repeated filling directly with the finger will result in sore fingers and even cuts. Some people with limited dexterity may not be able to perform the precise movements required to load a cartridge into a magazine. Another consequence is the amount of time required to load high-capacity magazines. Individually loading cartridges into a magazine is a time-consuming process, in and of itself With the higher forces involved, individually loading cartridges into high-capacity magazines takes even longer.

Further, magazines are not universal between firearm platforms. Each magazine is designed to cooperatively engage the magazine well of a particular firearm platform. This means that magazines for each firearm platform having specific dimensions, shapes, and engagement features. Prior art loaders are designed to work with magazines for a single platform.

Therefore, it is necessary to provide a magazine loader for solving the issues.

SUMMARY

In view of this, the present disclosure is designed to provide a magazine loader, which can satisfy different calibre cartridges, solve the problem of difficulty in loading cartridges, and facilitate users to quickly load.

The magazine loader for loading a cartridge into a magazine, comprising a housing having a recessed portion as a magazine opening for receiving at least a portion of the magazine. The recessed portion of the housing has a front wall, a rear wall disposed opposite the front wall and a bottom wall between the front wall and the rear wall, a cartridge opening is arranged on the rear wall. A cartridge loading slide with an angle relative to a horizontal line is located on the bottom wall of the recessed portion, one end of the cartridge loading slide is adjacent to the rear wall and the other end extends towards the front wall. The cartridge loading slide has a linear channel aligned with the cartridge opening, so that the cartridge enters the linear channel from the cartridge opening, and the cartridge slides toward one end of the cartridge loading slide away from the cartridge opening. A length of the linear channel is less than a distance between the front wall and the rear wall and greater than a width of the magazine. A guider adjacent the rear wall guides the magazine toward the cartridge loading slide so that the magazine can be aligned with the linear channel.

In accordance with other exemplary embodiments of the disclosure, the length of the linear channel is adjusted by an adjuster via a stopper.

In accordance with other exemplary embodiments of the disclosure, the stopper includes a positioning seat and a positioning protrusion extending from the positioning seat along a X-axis direction of the magazine loader, the positioning seat is sandwiched between the adjuster and the cartridge loading slide.

In accordance with other exemplary embodiments of the disclosure, a first elastic member is provided a restoring force to the stopper and has one end abutting against the positioning seat and the other end abutting against the housing.

In accordance with other exemplary embodiments of the disclosure, the adjuster has a has a wedge for matching the positioning seat of the stopper, and an adjusting button connecting to the wedge.

In accordance with other exemplary embodiments of the disclosure, a limiting block is respectively provided on both sides of the cartridge loading slide for preventing the cartridge from slipping off the cartridge loading slide.

In accordance with other exemplary embodiments of the disclosure, the limiting block has a limiting seat and a limiting protrusion extending upward from the limiting seat, and the limiting protrusion may be elastically floated by a second elastic member.

In accordance with other exemplary embodiments of the disclosure, a distance between two limiting protrusions of the limiting block is smaller than a thickness of the magazine.

In accordance with other exemplary embodiments of the disclosure, the guider includes a guiding seat supported by a third elastic member and a guiding protrusion extending upward from the guiding seat.

In accordance with other exemplary embodiments of the disclosure, a space between the two guiding protrusions is defined as a guiding groove, a width of the guiding groove is gradually reduced from top to bottom toward the cartridge loading slide.

In accordance with other exemplary embodiments of the disclosure, a wing is derived from both sides of the rear wall.

BRIEF DESCRIPTION OF DRAWINGS

Many aspects of the embodiment can be better understood with reference to the following drawings. The components in the drawings are not necessarily drawn to scale, the emphasis instead being placed upon clearly illustrating the principles of the embodiment.

DETAILED DESCRIPTION

Figure 1:
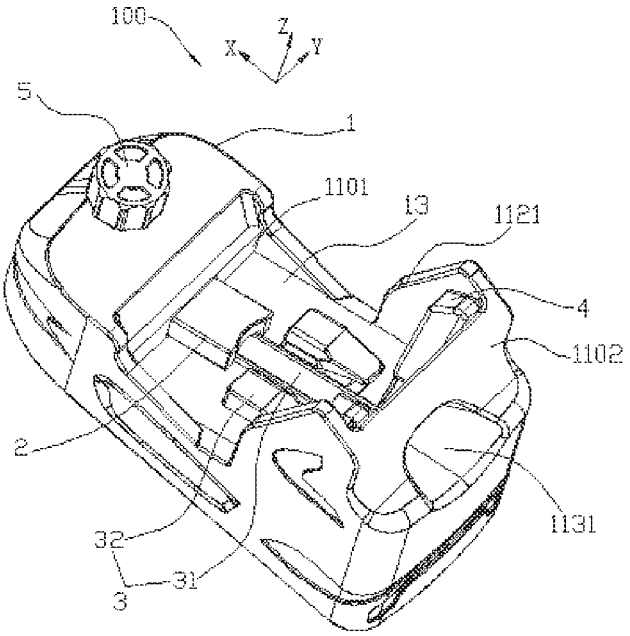
FIG. 1 is an isometric view of a magazine loader in accordance with an exemplary embodiment of the present disclosure.
Figure 2:
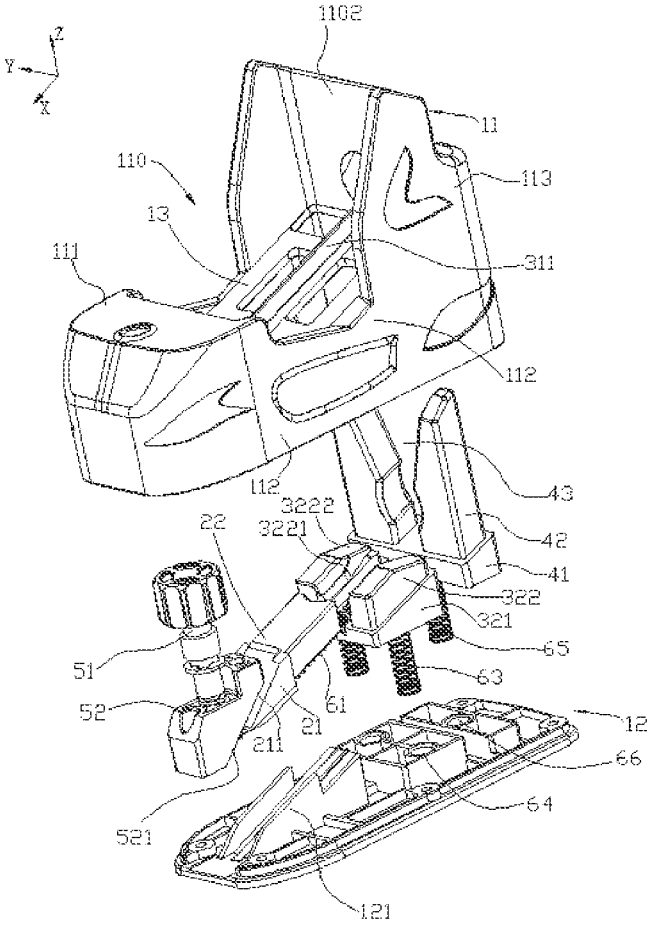
FIG. 2 is an isometric exploded view of the magazine loader in FIG. 1, viewed from another aspect.
Figure 3:
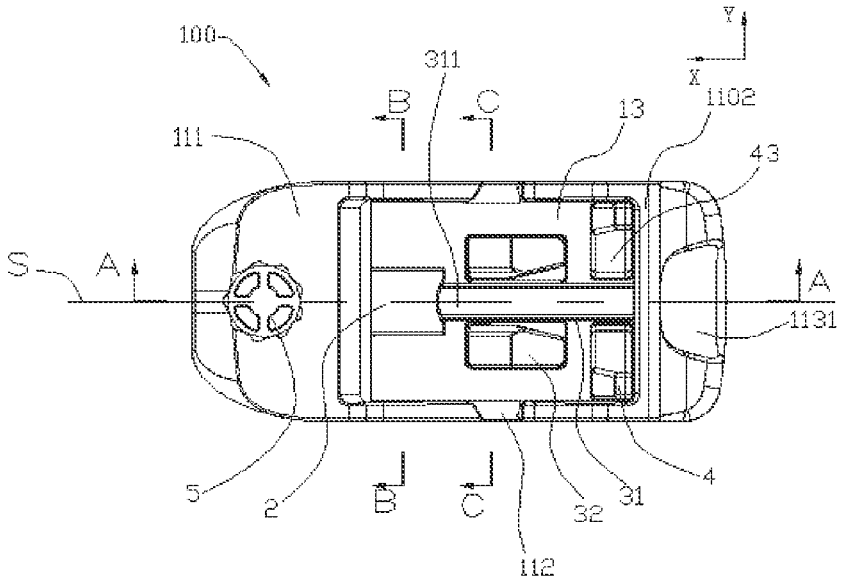
FIG. 3 is a top view of the magazine loader in FIG. 1.

Embodiment of the present disclosure will be described in detail in conjunction with the drawings. It should be noted that the figures are illustrative rather than limiting. The figures are not drawn to scale, do not illustrate every aspect of the described embodiment, and do not limit the scope of the present disclosure.

In the disclosure, the terms "first" and "second" are only used for descriptive purposes and cannot be understood as indicating or implying relative importance or implicitly indicating the number of indicated technical features. Thus, the features defined with "first" and "second" can explicitly or implicitly include one or more of the features. In the description of the invention, "multiple" means two or more, unless otherwise specifically defined.

It is appreciated that the shape of each part described below is "rectangular", "square" indicates a rough shape, and there may be rounded corners between adjacent sides or no rounded corners. Furthermore, the azimuth relationship qualifiers such as "parallel", "vertical", "consistent direction", "same direction", "opposite direction", etc. used by each component described below indicate the approximate orientation that allows for a certain error.

Referring to FIGS. 1 to 22, a magazine loader 100 for loading a cartridge 200 into a magazine 300. In order to facilitate the description of each of the following embodiment, an X-Y-Z coordinate system is established. Specifically, the length direction of the definition magazine loader 100 is the X-axis direction, the width direction of the magazine loader 100 is the Y-axis direction, and the height direction of the magazine loader 100 is the Z-axis direction. It is understandable that the coordinate system setting of the magazine loader 100 can be flexibly set according to actual needs, and is not specifically limited here.

Aspects of the magazine loader suitable for multiple calibre cartridges is described herein and illustrated in the accompanying figures. The loader 100 provides two main features. First, the loader provides the capability to pick up cartridges of ammunition in a wide variety of calibres. Second, the loader has a body that accommodates one magazine at a time. The loader 100 has an alignment function that aligns the magazine feed port with the loader rail to receive the cartridge as the magazine slides down along the rail. A cartridge 200 adapted to be loaded in the magazine 300 includes a body 202 having a powder portion and a warhead 201.

In the present disclosure, the term "front" generally refers to the portion nearest the warhead of the cartridge 200. The term "slidably" means that the referenced structures can slide with respect to one another. Depending on context, the term "connected" can be directly and fixedly connected, such as with glue or mechanical fasteners. The term "connected" can also mean indirectly or non-fixedly connected. The disclosed embodiment of the disclosure is generally symmetrical left to right although symmetry is not a requirement or limitation of the invention. For brevity, the specification may limit discussion of symmetrical or duplicate structures where it is apparent that identical discussion would apply to such structures.

The magazine loader 100 includes a housing 1, a stopper 2, a cartridge loading mechanism 3, a guider 4, an adjuster 5 mounted on the housing 1 in conjunction with the stopper 2. The housing 1 is configured in a generally rectangular shape and is used with one magazine 300 at a time. The stopper 2 is configured to cooperate with the cartridge loading mechanism 3 for abutting the warhead 201 of the cartridge 200 to limit the sliding distance. The cartridge loading mechanism 3 is configured such that the cartridge 200 slides on the loader 100.

The housing 1 includes an upper casing 11 and a base 12 mounted on the upper casing 11. The upper casing 11 includes a recessed portion 110 as a magazine opening for receiving at least a portion of the magazine 300. The magazine opening can be sized in relative proportions to receive the magazine 300. In the present disclosure, the magazine opening is significantly larger than the relative size of the magazine in both the X-axis and Y-axis directions. The upper casing 11 has a front portion 111, a middle portion 112 and a rear portion 113. The recessed portion 110 is arranged in the middle portion 112 and the rear portion 113. The recessed portion 110 has a front wall 1101, a rear wall 1102 disposed opposite the front wall 110 and a bottom wall 13 between the front wall 1101 and the rear wall 1102. In the present disclosure, the bottom wall 13 is an inclined surface away from the horizontal direction. The height of the rear wall 1102 is higher than that of the front wall 1101 so as to provide sufficient support for the guider 4. Since the bottom wall 13 is inclined, the bottom wall 13 has an included angle $\alpha$ with the horizontal plane. In this embodiment, the included angle $\alpha$ is greater than or equal to 5°. The included angle α between the bottom wall 13 and the horizontal plane is less than 60°. The height of the rear wall 1102 is higher than that of the front wall 1101 so as to provide sufficient support for the guider 4. In the present disclosure, the cartridge loading mechanism 3 has a cartridge loading slide 31 in a slideway form. The cartridge loading slide 31 is mounted on the bottom wall 13, one end of the cartridge loading slide 31 is adjacent to the rear wall 1102 and the other end extends towards the front wall 1101. The length of cartridge loading slide 31 is L4. Since the bottom surface 13 is inclined, the cartridge loading slide has an inclination angle that is the same as the inclination angle α of the bottom surface 13. In general, the inclination direction and angle of the bottom wall 13 and the cartridge loading slide 31 are consistent. The base 12 has a frame 121 for supporting some elements such as stoppers located inside the upper casing 11.

In the embodiment, the cartridge loading slide 31 protrudes from the bottom wall 13 and has a linear channel 311 on a top surface of the cartridge loading slide 31. The cartridge 200 can slide in the linear channel 311. Optionally, the linear channel 311 may be defined as a groove on the top surface of the cartridge loading slide 31 along the included angle direction, which is a bearing concave surface for supporting the cartridge 200. The width of the bearing concave surface is slightly smaller than the diameter of the cartridge 200, but it is still enough to support the cartridge from falling. The width of the bearing concave surface is smaller than the width of the mouth of the magazine so that the cartridge loading slide 31 does not collide with the magazine when the cartridge 200 is pressed into the magazine. One end of the linear channel 311 extends toward the front wall 1101, and the other end abuts the rear wall 1102.

In the present disclosure, the stopper 2 may be displaced relative to the cartridge loading slide along the cartridge loading slide direction so that a length 13 of the linear channel 311 may be adjusted. The stopper 2 includes a positioning seat 21 and a positioning protrusion 22 extending from the positioning seat 21 along the X-axis for covering a portion of the linear channel 311. At least a portion of the positioning protrusion 22 above the cartridge loading slide along the direction of the cartridge loading slide. The positioning seat 21 is sandwiched between the adjuster 5 and the cartridge loading slide 31. The positioning seat 21 is usually connected with the adjuster 5. The positioning seat 21 adjusts the length L3 of the linear channel 311 covered by the positioning protrusion 22 via the adjuster 5. In other embodiments, the positioning seat may be omitted. The adjuster is directly connected to the positioning protrusion. In the present disclosure, the positioning seat 21 is installed inside the front portion 111 of the upper casing 11 and the positioning protrusion 22 at least partially exposed in the recessed portion 110. The positioning seat 21 is in the shape of a wedge, which includes a second abutting surface 211 for abutting against the adjuster 5. A first accommodating cavity 62 between the positioning seat 21 and base 12 for accommodating a first elastic member 61 for providing a restoring force to the stopper 2. One end of the first elastic member 61 abuts against the positioning seat 21, and the other end abuts against the base 12 of the housing 1. The first elastic member 61 is a metal spring. Thus, the stopper 2 slides on the cartridge loading slide 31.

Furthermore, the positioning protrusion 22 is provided with a positioning surface 221 for abutting against the warhead 201 of the cartridge 200. The length of the positioning protrusion 22 exposed on the cartridge loading slide 31 may be adjusted. The exposed length of the positioning bump 22 determines the effective length of the linear channel 311. In order to load cartridges of different lengths, the length L3 of the linear channel 311 is at least greater than a width of the magazine 300 for loading the cartridges. The width of the magazine 300 refers to the length W of the magazine along the X-axis direction. The adjuster 5 has a wedge 52 inside in the upper casing 11 for matching the positioning seat 21, and an adjusting button 51 exposed outside the housing 1. The wedge 52 has a first abutting surface 521 which slides relative to the second abutting surface 211. User adjusts the length of the linear channel 311 by pressing or twisting the adjusting button 51 so that the wedge 52 forces the positioning seat 21 to move so that the length L3 of the linear channel 311 is covered by the positioning protrusion 22. In this embodiment, the adjustment button 51 is a knob. The knob is provided in the front portion of the housing 1. The knob is turned, the second abutting surface 211 is abutted against by the first abutting surface 521 so that the positioning protrusion 22 occupies a portion of the linear channel 311. After the wedge 52 is withdrawn, the stopper 2 slides under the reaction force of the first elastic member 61, so that the length of the linear channel is adjusted to be longer. In the other embodiment, the adjuster 5 may be directly physically connected with the stopper 2.

Figure 4:
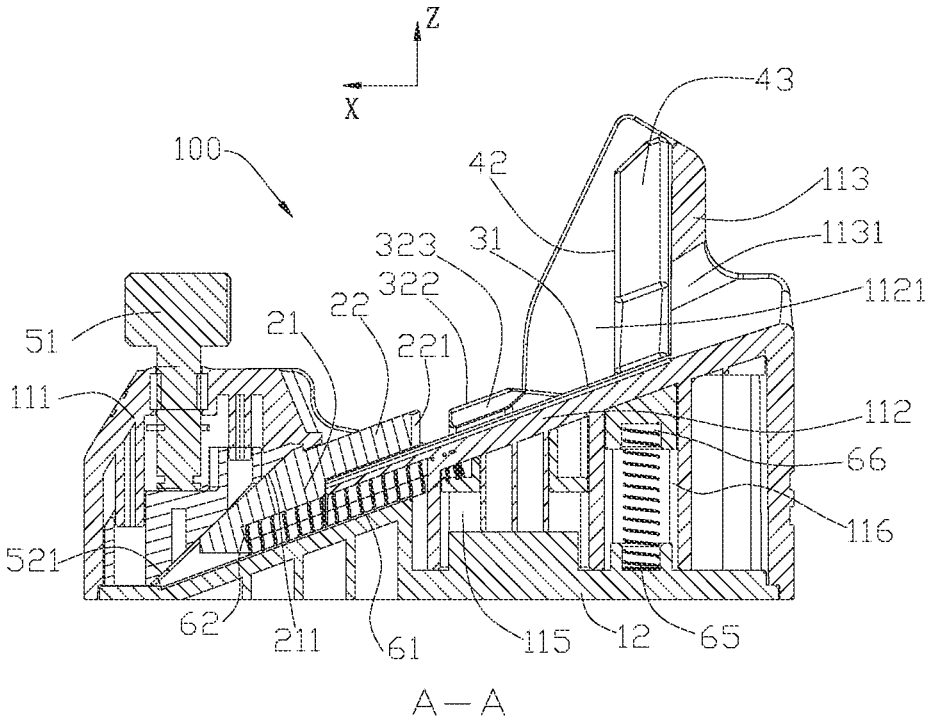
FIG. 4 is a cross-sectional view of the magazine loader taken along line A-A in FIG. 3.
Figure 5:
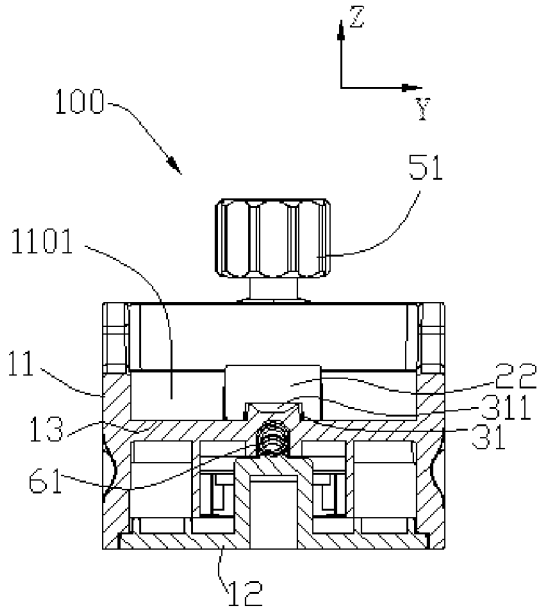
FIG. 5 is a cross-sectional view of the magazine loader taken along line B-B in FIG. 3.
Figure 6:
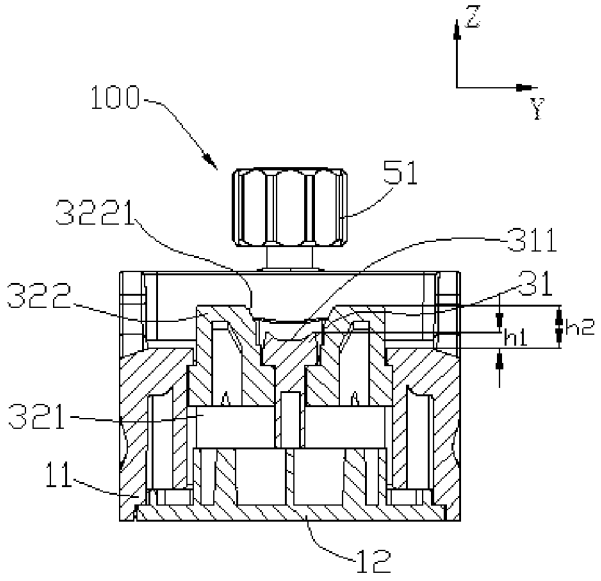
FIG. 6 is a cross-sectional view of the magazine loader taken along line C-C in FIG. 3.
Figure 7:
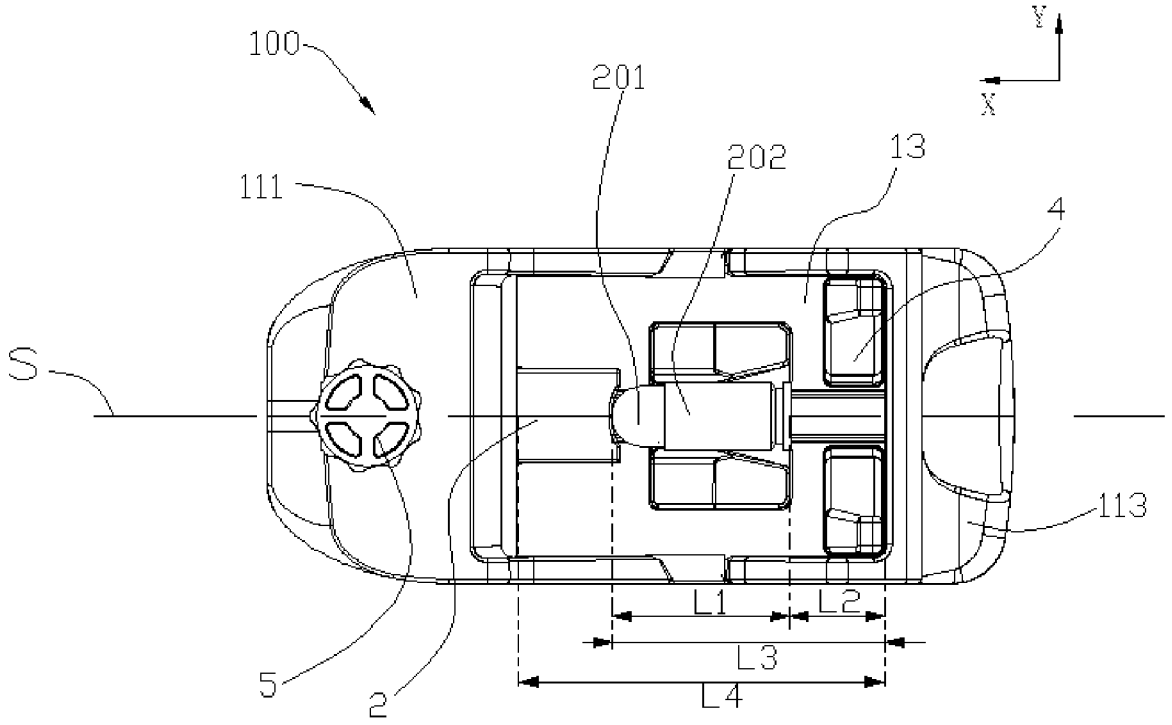
FIG. 7 is a top view of the magazine loader being carried one cartridge in FIG. 3.

Referring to FIG. 4, when the height of the wedge 52 is adjusted to a lowest position, the first elastic member 61 is compressed to the extreme. Then, an exposed length of the stopper 2 is the largest, and a distance that the cartridge may slide in the linear channel 311 on the cartridge loading slide 31 is the shortest. A shortest length of the linear channel 311 is also greater than the length L1 of one cartridge. In the present disclosure, the length of the linear channel 311 is the sum of the distance L2 the cartridge may slide on the cartridge loading slide plus the length L1 of the cartridge itself. Similarly, when the height of the wedge 52 is adjusted. to a highest position, the first elastic element 61 is released to its maximum length. Then, at least a portion of the stopper 2 is accommodated inside the front portion 111 of the housing 1. In other embodiments, the stopper 2 may be configured to be fixed on the housing 1. For example, the stopper 2 is integrally formed with the housing 1, or the stopper 2 is mounted on the housing 1 by screw connection or snap connection.

An inclined surface of the wedge 52 away from the adjusting button 51 is provided with the first abutting surface 521. It can be understood that a side surface of the stopper 2 facing the first abutting surface 521 is the second abutting surface 211. In other embodiments, two or three or more first elastic members 61 may be provided, which is not limited herein.

In other embodiments, the first elastic member 61 may also be omitted. The stopper 2 is connected to the housing 1 by a thread means so that the adjuster 5 is twisted to adjust the position of the stopper 2. Alternatively, the stopper 2 is provided with a buckle, and the housing 1 is provided with a plurality of locking grooves, and the position of the stopper 2 is adjusted through the cooperation of the buckles with the locking grooves at different positions.

In the embodiment, at least a portion of the cartridge loading slide 31 is provided between the positioning protrusion 22 and the first elastic member 61. The first elastic member 61 is supported by the base 12 of the housing 1. One end of the first elastic member 61 abuts against the stopper 2 and the other end of the first elastic member 61 abuts against the base 12. In the embodiment, the first elastic member 61 is a spring. The stop 2 can move under the force of the spring 61 along the direction of the cartridge loading slider 31.

The cartridge loading mechanism 3 further includes a limiting block 32 provided on two sides of the cartridge loading slide 31 for preventing the cartridge from slipping off the cartridge loading slide 31. The limiting block 32 may be elastically exposed on the bottom wall 13. Furthermore, each of the limiting block 32 includes a limiting seat 321 and a limiting protrusion 322 extending upward from the limitinu seat 321. The limit seat 321 is used to prevent the limiting block 32 from falling off the housing 1. A height H2 of the limiting seat 321 is greater than a height H1 of the cartridge loading slide 31. A distance L5 between two limiting protrusions 322 of the limiting block 32 is smaller than a thickness T of the magazine 300.

A second elastic member 63 is disposed below the limiting seat 321. The second elastic member 63 elastically supports the limiting block 32 so that of the limiting protrusions 322 are elastically exposed on the bottom wall of the housing 1.

A height of the limiting protrusion 322 is higher than that of the cartridge loading slide 31 to prevent the cartridge from falling off the cartridge loading slide 31. A distance between the two limiting protrusions 322 is slightly smaller than a thickness of the magazine 300, so that when the magazine slides on the cartridge loading slide 31, the limiting protrusion 322 may be pressed down by the magazine 300. In addition, the distance between the two limiting protrusions 322 is slightly greater than the diameter of the cartridge 200, so that the cartridge 200 may slide adaptively on the cartridge loading slide 31.

One side of each limiting protrusion 322 adjacent to the linear channel 311 and has a first chamfer 3221 to accommodate different sizes of cartridges 200. Each of the limiting protrusion 322 is provided with a second chamfer 3222 in the direction away from the front wall 1101 for guiding the magazine 300 so as to facilitate the magazine 300 to slide down the limiting block 32 without resistance. Correspondingly, the bottom wall 13 is provided with a hole for accommodating the limiting protrusion 322, and the limiting protrusion 322 is supported by the second elastic member 63 to expand and contract in the hole of the bottom wall 13.

There are two second elastic members 63 corresponding to the limiting protrusions 322. The second elastic member is accommodated in a second accommodating cavity 64 on the base 12. One end of the second elastic member 63 abuts against the limiting block 32 and the other end of the second elastic member 63 abuts against the base 12. In other embodiments, only one or three or more second elastic members 63 may be provided, which is not limited herein. In other embodiments, the limiting seat 32 may be divided into two independent limiting seats, and the two limiting protrusions 322 respectively extend from the corresponding limiting seats.

Similarly, the guider 4 includes a guiding seat 41 and a guiding protrusion 42 extending upward from the guiding seat 41. The guide 4 is disposed adjacent to the rear wall 113 of the housing 1, which guides the magazine 300 to move along the X-axis direction toward the cartridge loading slide 31 so that the mouth 301 of the magazine 300 may abut against the cartridge loading slide 31 and align with the linear channel 311. As can be understood from the context, the term "align" here means that the mouth 301 of the cartridge 300 is in line with the linear channel 311 and the cartridge opening. Correspondingly, the bottom wall 13 is provided with a hole for accommodating the guiding protrusion 42. The two guiding protrusions 42 may be independently separated. A space between the two guiding protrusions 42 is defined as a guiding groove 43. A width of the guiding groove 43 decreases from top to bottom, and a minimum distance is less than the thickness of the magazine. The guiding seat 41 is elastically supported by a third elastic member 65 received in the base 11 One end of the third elastic member 65 abuts against the guiding seat 41 and the other end of the third elastic member 65 abuts against the base 12. The base 12 has a third accommodating cavity 66 for accommodating the third elastic members 65. The two limiting protrusions 322 and the two guiding protrusions 42 are symmetrically arranged on both sides of the cartridge loading slide 31 as a symmetry axis. In the embodiment, each guiding protrusion 42 has a wedge-like shape with an inclined surface. The guiding groove 43 provided between the two inclined surfaces becomes a groove with a gradually changing width.

When the magazine 300 enters the magazine opening from the guiding groove 43, the mouth 301 of the magazine 300 abuts against the guiding protrusion 42 so that the mouth of the magazine gradually approaches the cartridge loading slide 31. In the present disclosure, the guider 4 is provided adjacent to the rear wall 1102. A wing 1121 is derived from both sides of the rear wall 1102. Furthermore, the guiding protrusions 43 are located between the rear wall 1102 and the wings 1121. The rear wall 1102 and the wings 1121 may prevent the guiding protrusion 42 from being excessively inclined during movement at least from the X-axis direction and the Y-axis direction.

In the present disclosure, a cartridge opening 1131 is provided on the rear wall 1102, The cartridge opening 1131 is aligned with the cartridge loading slide 31 and communicated with the linear channel 311. The cartridge 200 enters the linear channel 311 from the cartridge opening 1131 and is supported by the cartridge loading slide 31. Generally, the cartridge opening 1131 and the cartridge loading slide 31 are all located in a straight line.

In the present disclosure, it can be understood that the front part 111, the middle part 112 and the rear part 113 refer to different areas of the loader 100 along the X-axis direction. The base of the housing 1 is provided with a first installing cavity 114 for accommodating the stopper 2, a second installing cavity 115 for installing the limiting seat 321 of the limiting block 32, and a third installing cavity 116 for the guiding seat 41 of the guider 4.

While assembled, one cartridge 200 is placed on the cartridge loading slide 31 from the cartridge opening 1131, that is, the cartridge 200 slides in the inclined linear channel 311 towards the front wall 1101. Finally, the cartridge 200 is stopped by the stopper 2 and stops sliding. In other embodiments, it is possible that the warhead 201 of the cartridge 200 is abutted by the front wall 1101. The hollow magazine 300 is inserted into the magazine opening with the rear wall 1102 serving as a reference. The mouth 301 of the magazine 300 abuts on the cartridge loading slide 31 accordingly to the guider 4. The magazine 300 slides along the cartridge loading slide 31 toward the position where the cartridge 200 is located. During this process, the mouth 301 of the magazine 300 passes over the guiding protrusion 42 and then receives the cartridge 200. During the loading process, the magazine slides from top to bottom along the direction of the cartridge loading slide 31. The composite ergonomic design makes the whole loading fast and labour-saving, and the loading accuracy is high.

Figure 8:
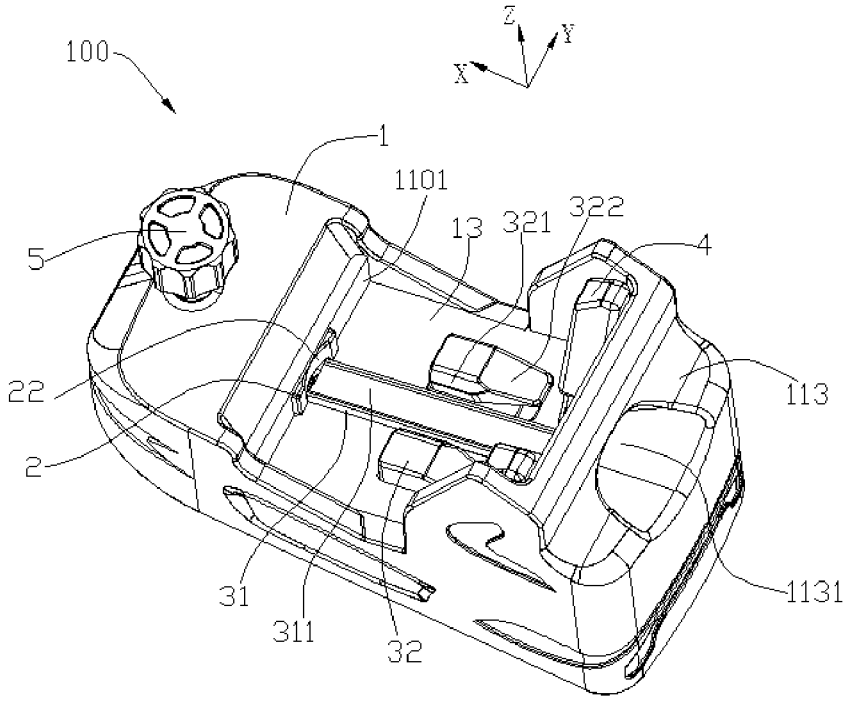
FIG. 8 is an isometric view of the magazine loader in FIG. 7, with a stopper being hidden.
Figure 9:
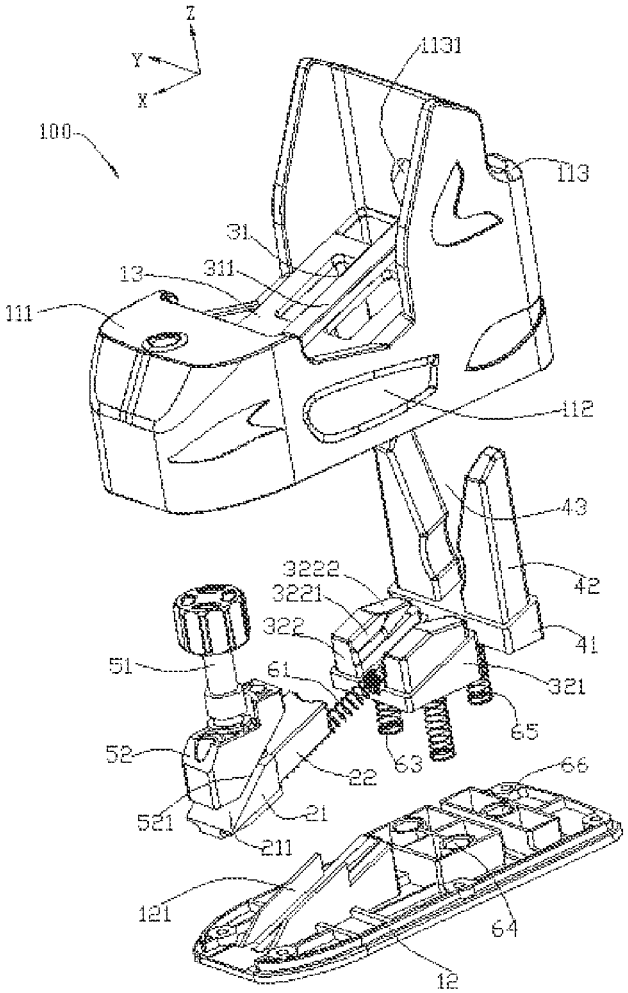
FIG. 9 is an isometric exploded view of the magazine loader in FIG. 7.
Figure 10:
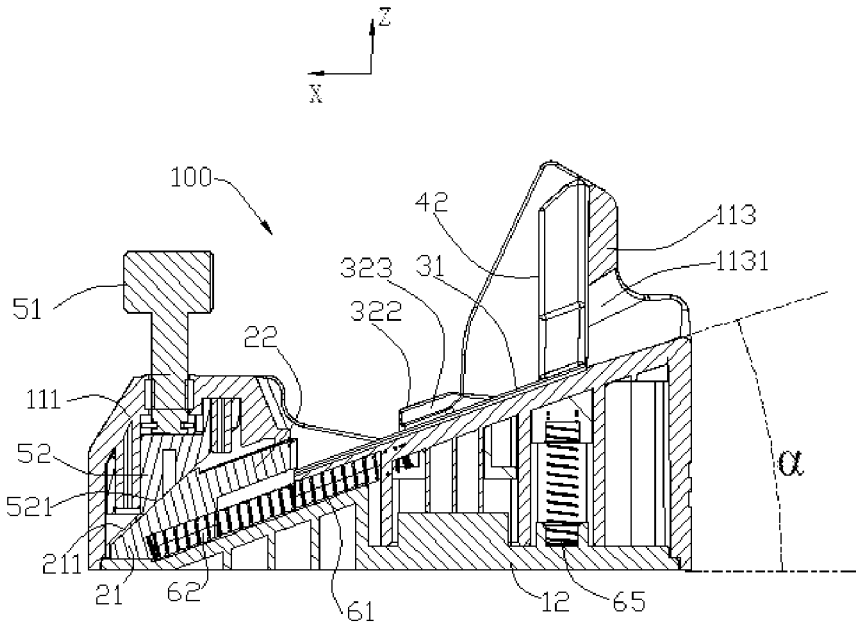
FIG. 10 is a cross-sectional view of the magazine loader in FIG. 7.
Figure 11:
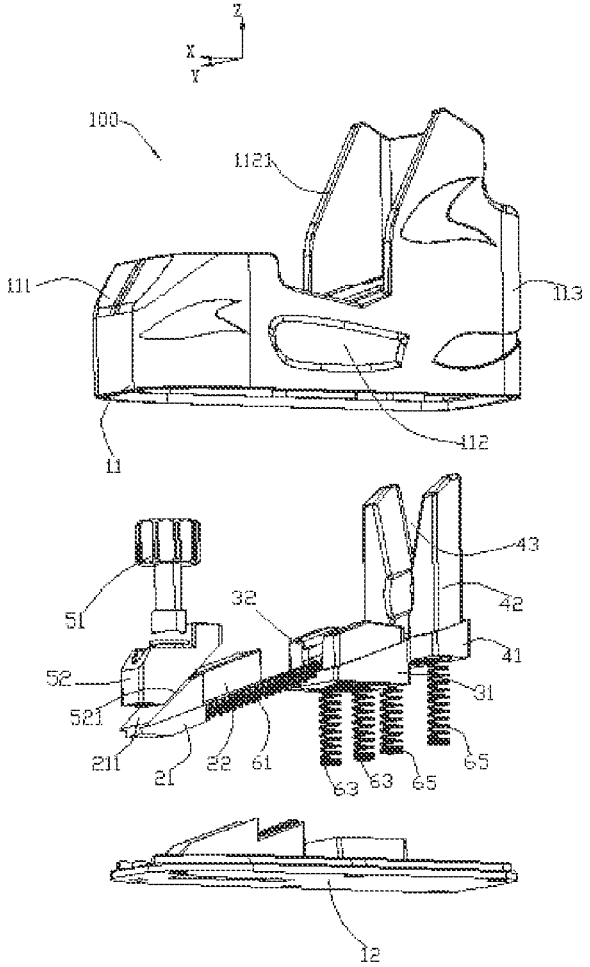
FIG. 11 an isometric exploded view of the magazine loader in FIG. 7, viewed from another aspect.
Figure 12:
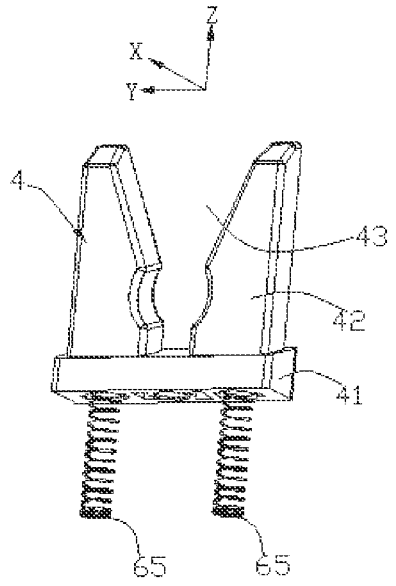
FIG. 12 is an isometric view of a guider of the magazine loader in FIG. 7.
Figure 13:
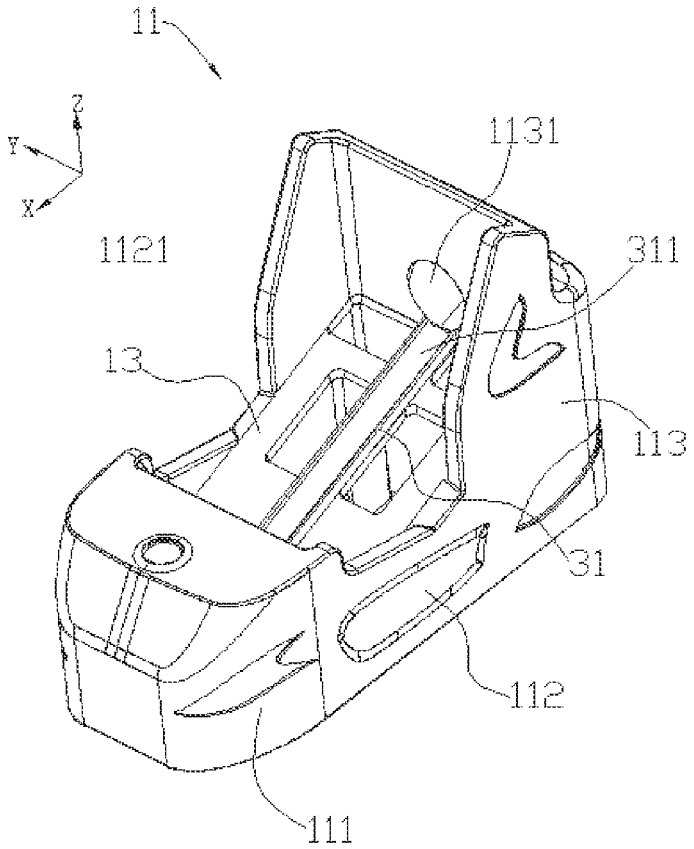
FIG. 13 is an isometric view of a housing of the magazine loader in FIG. 7 with enteral components being removed away.
Figure 14:
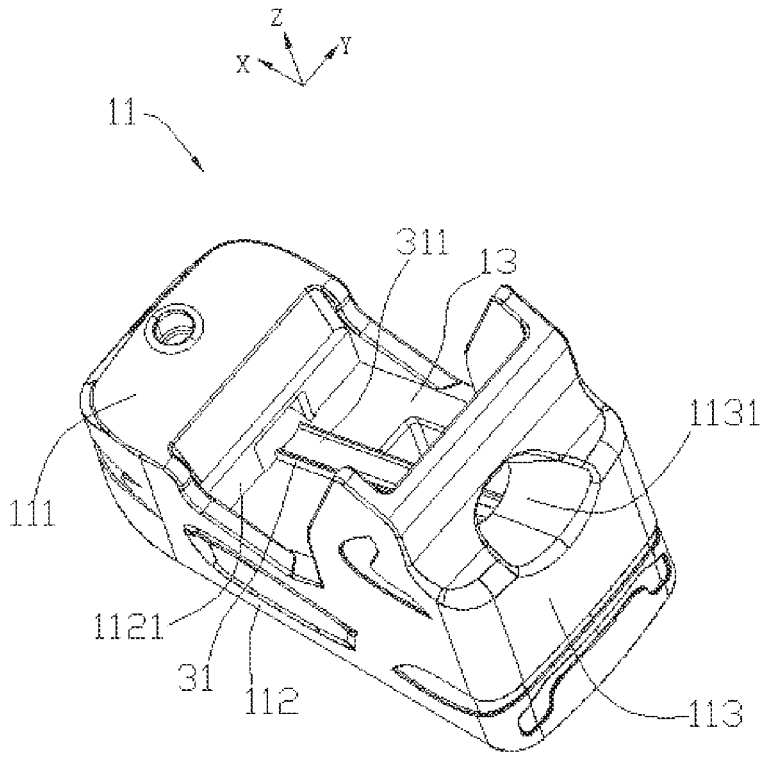
FIG. 14 is an isometric view of the housing of the magazine loader in FIG. 13, viewed from another aspect.
Figure 15:
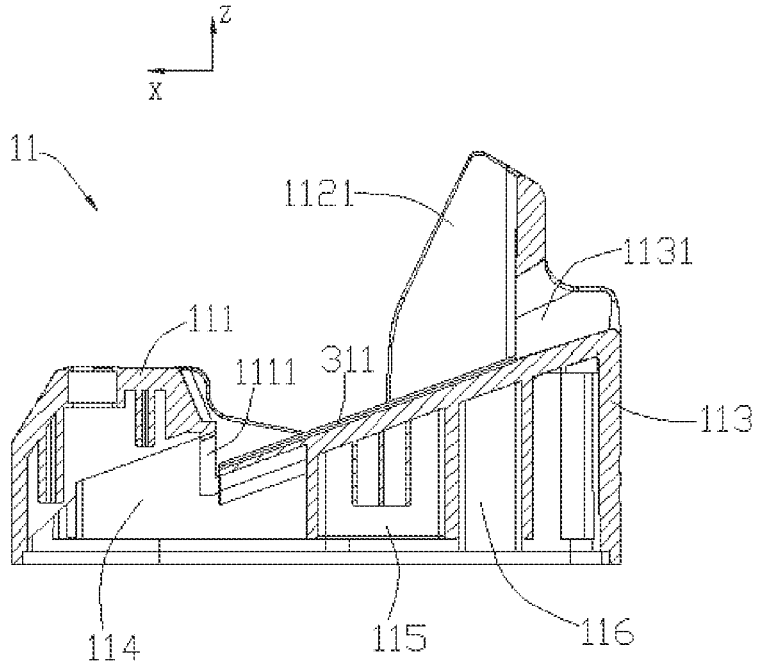
FIG. 15 is a cross-sectional view of the housing of the magazine loader in FIG. 13.
Figure 16:
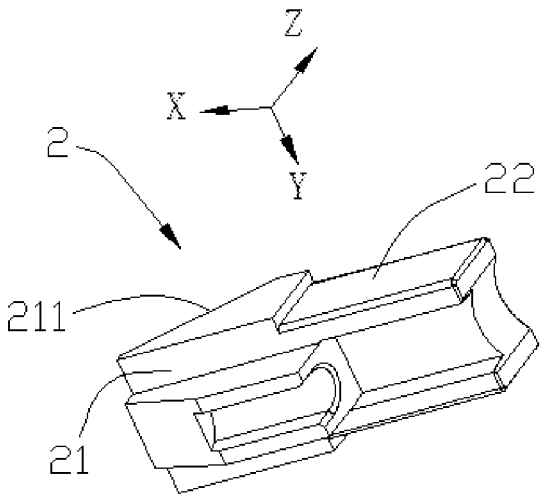
FIG. 16 is an isometric view of the stopper of the magazine loader in FIG. 1.
Figure 17:
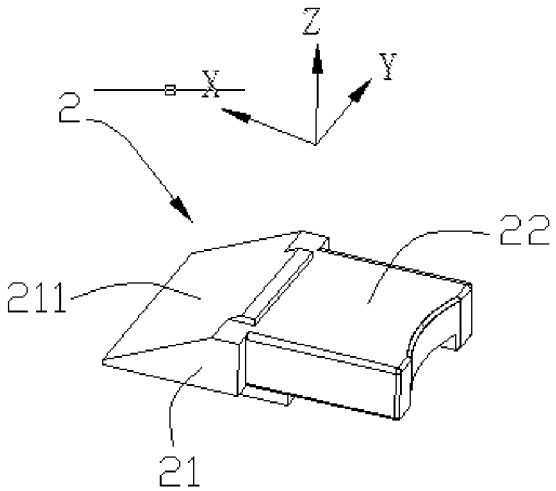
FIG. 17 is an isometric view of the stopper in FIG. 16, viewed from another aspect.
Figure 18:
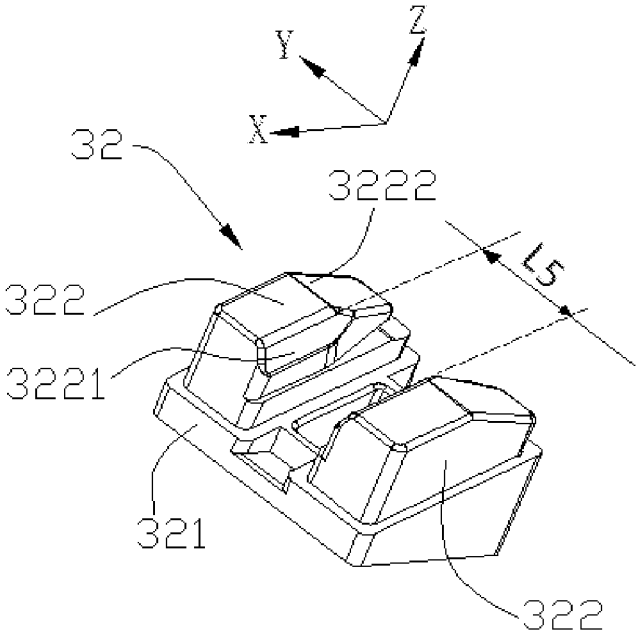
FIG. 18 is an isometric view of a position-limiting block of the magazine loader in FIG. 1.
Figure 19:
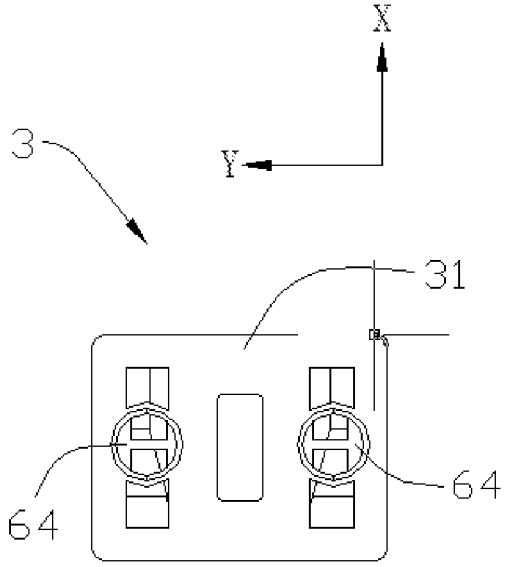
FIG. 19 is a bottom view of the position-limiting block in FIG. 18.
Figure 20:
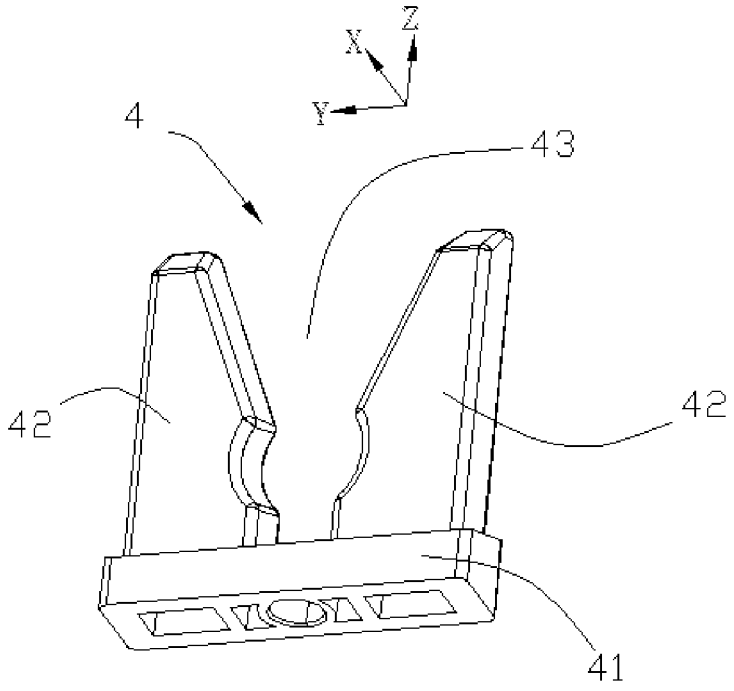
FIG. 20 is an isometric view of the guider of the magazine loader in FIG. 12, viewed from another aspect.
Figure 21:
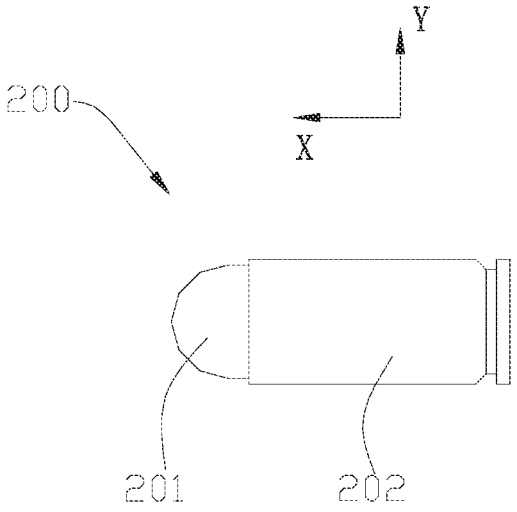
FIG. 21 is an isometric view of one cartridge.
Figure 22:
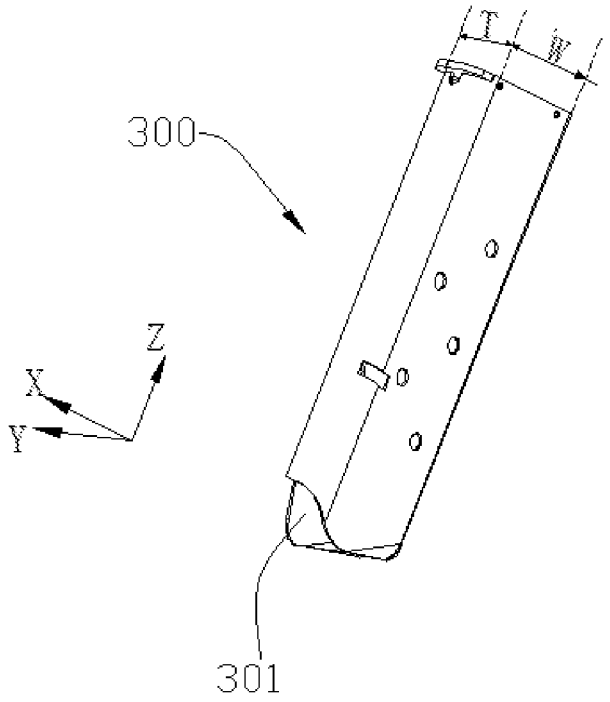
FIG. 22 is an isometric view of a standard magazine which may be adapted for the magazine loader.

When loading cartridges 200 of different calibres, the adjuster 5 adjusts the position of the stopper 2 to increase or decrease the length L3 of the linear channel 311, so that different lengths of cartridges 200 can be adapted. Referring to FIGS. 8 to 10, when the distance between the stopper 2 and the cartridge opening 1131 is adjusted to become larger, the adjusting button 51 may be twisted and selected to retract the stopper 2 into the housing 1.

In the present disclosure, the guider 4 and the cartridge loading slide 31 on the inclined bottom wall 13 are adapted to guide the magazine 300 so that the cartridges 200 may be loaded into the magazine 300 quickly and accurately, which changes the traditional way of directly pressing into the magazine. The loader 100 solves the problem of alignment when the cartridge 200 is loaded, as well as the hassle and difficulty of loading. The user is effortless and the hand is not prone to injury or fatigue, resulting in a good user experience.

While the present disclosure has been descirbed with reference to a specific embodiment, the description of the disclosure is illustractive and is not to be constnied as limiting the disclosure. Various of modifications to the present discloure can be made to the exemplary embodiment by those skilled in the art without departing from the ture spirit and scope of the disclosure as defined by the appended claims.

What is claimed is:

1. A magazine loader for loading a cartridge into a magazine, comprising a housing having a recessed portion as a magazine opening for receiving at least a portion of the magazine, and wherein the recessed portion of the housing has a front wall, a rear wall disposed opposite the front wall and a bottom wall between the front wall and the rear wall, a cartridge opening is arranged on the rear wall;

a cartridge loading slider with an angle relative to a horizontal line is located on the bottom wall of the recessed portion, one end of the cartridge loading slider is adjacent to the rear wall and the other end extends towards the front wall;

the cartridge loading slider has a linear channel aligned with the cartridge opening, so that the cartridge enters the linear channel from the cartridge opening, and the cartridge slides toward one end of the cartridge loading slider away from the cartridge opening;

a guider adjacent the rear wall guides the magazine toward the cartridge loading slider so that the magazine can be aligned with the linear channel;

wherein a length of the linear channel is adjusted by an adjuster and a stopper.

2. The magazine loader as described in claim 1, wherein the stopper includes a positioning seat and a positioning protrusion extending from the positioning seat along an X-axis direction of the magazine loader, the positioning seat is sandwiched between the adjuster and the cartridge loading slider.

3. The magazine loader as described in claim 2, wherein a first elastic member is provided a restoring force to the stopper and has one end abutting against the positioning seat and the other end abutting against the housing.

4. The magazine loader as described in claim 2, wherein the adjuster has a has a wedge for matching the positioning seat of the stopper, and an adjusting button connecting to the wedge.

5. The magazine loader as described in claim 1, wherein a limiting block is respectively provided on both sides of the cartridge loading slider for preventing the cartridge from slipping off the cartridge loading slider.

6. The magazine loader as described in claim 5, wherein the limiting block has a limiting seat and a limiting protrusion extending upward from the limiting seat, and the limiting protrusion may be elastically floated by a spring.

7. The magazine loader as described in claim 1, wherein the guider includes a guiding seat supported by a spring and a guiding protrusion extending upward from the guiding seat.

8. The magazine loader as described in claim 7, wherein a space between the two guiding protrusions is defined as a guiding groove, a width of the guiding groove is gradually reduced from top to bottom toward the cartridge loading slider.

9. The magazine loader as described in claim 7, wherein a wing is derived from both sides of the rear wall.

10. A magazine loader for loading a cartridge into a magazine, comprising a housing having a recessed portion as a magazine opening for receiving at least a portion of the magazine, and wherein the recessed portion of the housing has a front wall, a rear wall disposed opposite the front wall, a bottom wall located between the front wall and the rear wall at an angle to a horizontal line, and a cartridge opening on the housing is communicated with the magazine opening;

a cartridge loading slider is located on the bottom wall ofthe housing and has a linear channel aligned with the cartridge opening;

when the cartridge is supported by the cartridge loading slider after entering the magazine opening from the magazine opening of the housing, the cartridge slides toward one end of the cartridge loading slider away from the cartridge opening;

wherein a stopper is provided on at least a portion of the cartridge loading slider for adjusting the length of the linear channel.

11. The magazine loader as described in claim 10, wherein an adjuster on the housing abuts the stopper forcing the stopper to move toward the cartridge opening along the direction of the cartridge loading slider.

12. The magazine loader as described in claim 11, wherein the stopper includes a positioning seat and a positioning protrusion extending from the positioning seat along an X-axis direction of the magazine loader, the positioning seat is sandwiched between the adjuster and the cartridge loading slider.

13. The magazine loader as described in claim 12, wherein a first elastic member for provided a restoring force to the stopper and has one end abutting against the positioning seat and the other end abutting against the housing.

14. The magazine loader as described in claim 10, wherein a limiting block is provided on two sides of the cartridge loading slider for preventing the cartridge from slipping off the cartridge loading slider.

15. The magazine loader as described in claim 14, wherein the limiting block has a limiting seat and a limiting protrusion extending upward from the limiting seat, and the limiting protrusion may be elastically floated by a spring.

16. The magazine loader as described in claim 10, wherein a guider is provided in the magazine opening, and the guide guides the magazine toward the magazine loading slider to align the linear channel.

17. The magazine loader as described in claim 16, wherein the guider includes a guiding seat supported by a spring and a guiding protrusion extending upward from the guiding seat, the spring has one end abutting against the guiding seat and the other end abutting against the housing.

* * * * *